US008607668B1

(12) United States Patent
Frank et al.

(10) Patent No.: US 8,607,668 B1
(45) Date of Patent: Dec. 17, 2013

(54) OPENING DEVICE

(76) Inventors: Vincent D. Frank, Avon, OH (US); Joseph P. Hanna, Westlake, OH (US)

( * ) Notice: Subject to any disclaimer, the term of this patent is extended or adjusted under 35 U.S.C. 154(b) by 259 days.

(21) Appl. No.: 13/219,924

(22) Filed: Aug. 29, 2011

Related U.S. Application Data

(60) Provisional application No. 61/517,888, filed on Apr. 27, 2011.

(51) Int. Cl.
*B67B 7/44* (2006.01)
*B67B 7/16* (2006.01)

(52) U.S. Cl.
USPC ..... 81/3.09; 81/3.57

(58) Field of Classification Search
USPC ..... 81/3.09, 3.57, 3.55; 7/151–153, 110; D8/18, 19, 33–43
See application file for complete search history.

(56) References Cited

U.S. PATENT DOCUMENTS

| | | | | | |
|---|---|---|---|---|---|
| 987,268 | A | * | 3/1911 | Thompson | 215/226 |
| 2,514,566 | A | * | 7/1950 | Capriccio | 53/363 |
| 2,609,962 | A | * | 9/1952 | Schultz | 220/274 |
| 3,415,093 | A | | 12/1968 | Newell | |
| 3,495,284 | A | * | 2/1970 | Weingardt | 7/152 |
| 4,309,921 | A | * | 1/1982 | Miller | 81/3.57 |
| 4,412,464 | A | * | 11/1983 | Cook | 81/3.09 |
| 4,463,631 | A | * | 8/1984 | Barnes et al. | 81/3.09 |
| D278,203 | S | * | 4/1985 | Braukmann | D8/40 |
| D282,714 | S | * | 2/1986 | Harvey | D8/43 |
| 4,607,407 | A | * | 8/1986 | Bergmeister | 7/156 |
| D302,234 | S | | 7/1989 | McNamee et al. | |
| 4,846,024 | A | * | 7/1989 | Bryant et al. | 81/3.09 |
| 4,923,392 | A | * | 5/1990 | Moynihan, III | 431/253 |
| 4,967,622 | A | * | 11/1990 | Phillips | 81/3.09 |
| D353,755 | S | | 12/1994 | Lane | |
| 5,535,644 | A | * | 7/1996 | Paul-Alexandre et al. | 81/3.09 |
| D391,134 | S | | 2/1998 | Laib | |
| 5,771,759 | A | * | 6/1998 | Warren | 81/3.09 |
| D420,265 | S | | 2/2000 | Pierce | |
| D435,412 | S | * | 12/2000 | Bentley | D8/38 |
| D488,689 | S | | 4/2004 | Smith, IV | |
| D501,381 | S | | 2/2005 | Kelleghan | |
| D544,767 | S | * | 6/2007 | Kelleghan et al. | D8/38 |
| 7,240,589 | B2 | | 7/2007 | Kehoe | |
| 7,343,835 | B2 | | 3/2008 | Jensen | |
| D624,378 | S | | 9/2010 | Wysopal | |
| D628,866 | S | | 12/2010 | Serret | |
| D637,463 | S | | 5/2011 | Silvers et al. | |
| D644,075 | S | | 8/2011 | Barnett | |
| 2007/0163393 | A1 | * | 7/2007 | Ondeck et al. | 81/3.57 |
| 2008/0127782 | A1 | * | 6/2008 | O'Brien | 81/3.09 |
| 2008/0173134 | A1 | * | 7/2008 | Lawson | 81/3.09 |
| 2009/0025513 | A1 | * | 1/2009 | Salvino | 81/3.57 |

* cited by examiner

*Primary Examiner* — David B Thomas
(74) *Attorney, Agent, or Firm* — Curatolo Sidoti Co., LPA; Salvatore A. Sidoti; Joseph G. Curatolo

(57) ABSTRACT

An opening device for opening sealed containers of various types. The opening device removes bottle caps, twist-off style bottle caps and opens stay-on-tab cans. The opening device increases the speed with which containers may be opened and helps to protect the hands by reducing the force needed to open the containers.

16 Claims, 8 Drawing Sheets

210
216
212
202

200
216
218
10
210
216
212
206
204
202
207
205
10
202

210
216
218
212
207
205
202

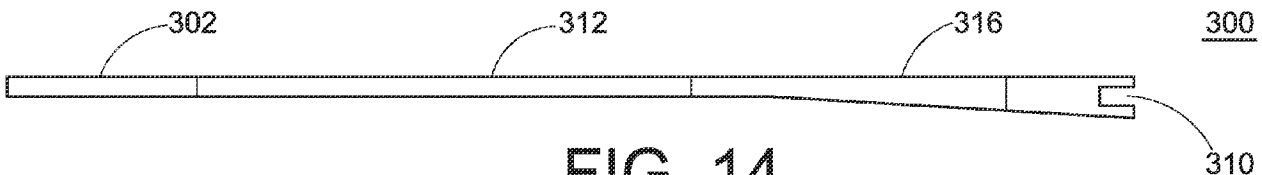
FIG. 14
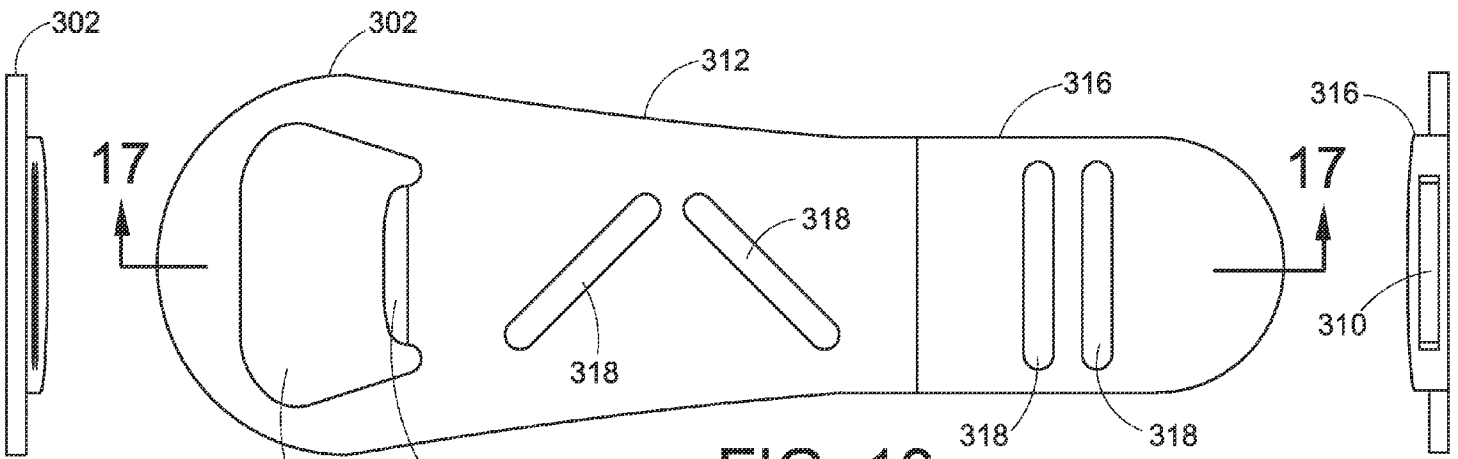
FIG. 13
FIG. 15
FIG. 16
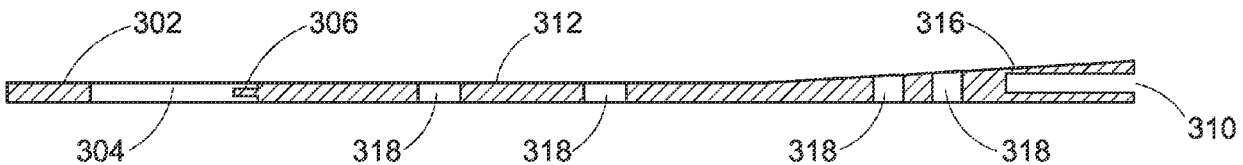
FIG. 17

OPENING DEVICE

CROSS REFERENCE TO RELATED APPLICATION

This application claims the benefit of the filing date of U.S. Provisional Application for Patent Ser. No. 61/517,888 filed on Apr. 27, 2011, which is hereby incorporated by reference in its entirety.

BACKGROUND

Crown-style bottle caps are used by bottling companies to seal many types of glass bottles, especially beverages bottled under pressure, such as beer or soft drinks. The circular central body of the crown-style cap has a pressure-tight lining on the internal surface which is placed against the bottle neck opening. The outer crown is made up of corrugations which are bent down to form teeth which hold the cap firmly on to the rim of the bottleneck. A bottle-opener is necessary to open a bottle sealed with the classic crown-style cap.

Alternatively, some beverage containers are sealed with a twist-off style crown cap. The twist-off crown cap is made of a regular crown-cap placed around the rim of a bottle which is fitted with a threaded portion for unscrewing the cap. Although this arrangement purports to eliminate the need for a bottle-opener, it is not very comfortable to open by hand. The cap is fixed very firmly to the bottle in order to maintain the pressure of the liquid inside the bottle and to avoid the risk of leakage during handling. Consequently, a significant amount of force, which not everyone may possess, is needed to rotate the cap in order to open the bottle. This operation also carries the risk of injuring or cutting the hands due to the sharp edges of the teeth on the crown.

Aluminum cans are another widely used beverage container. The beverage can stay-on tab opening mechanism has been in common use since the 1980's. The stay on-tab mechanism uses a pull ring tab attached to the upper surface of the beverage container as a lever to depress a scored part of the lid, which folds underneath the top of the can and out of the way of the resulting opening. A drawback of the stay-on-tab opening mechanism is that the pull ring is positioned flat to the top of the beverage container and can be difficult to grasp and lift. This can be a particularly difficult problem in situations where a large number of cans must be opened such as at a party, event or at a restaurant or bar. The action of prying the pull ring upwardly from the top surface of the can may cause damage to the fingers, fingertips and fingernails. The stay-on tab arrangement creates a hardship for arthritis and carpal tunnel sufferers as well, who may not have the hand strength or dexterity necessary to raise and lift the tab.

Carpal tunnel syndrome is commonly thought to be an affliction of administrative assistants and others who spend massive amounts of time at a keyboard typing. But carpal tunnel syndrome has a much wider reach. People such as bartenders, who use their wrists often in their daily activities opening multiple bottles and cans, are just as likely to get carpal tunnel syndrome as someone who works at a keyboard all day.

According to the National Institute for Occupational Safety and Health (NIOSH) Publication No. 2004-164, work-related musculoskeletal disorders result from repetitive movements that are performed over time or for a long period of time, which may result in damage to muscles, tendons, nerves, ligaments, joints, cartilage, or blood vessels. Hand and wrist disorders include carpal tunnel syndrome and tendinitis. National data suggests that a large number of injuries known as musculoskeletal disorders are attributable to hand tool use in occupational settings, resulting in unnecessary suffering, lost workdays and economic costs.

Similarly, many people have difficulty opening both bottle and can beverage containers due to a weak grip and lack of hand strength caused by arthritis. According to the U.S. Center for Disease Control and Prevention, an estimated 50 million U.S. adults (about 1 in 5) report doctor-diagnosed arthritis. As the U.S. population ages, these numbers are expected to increase sharply. The number of adults with doctor-diagnosed arthritis is projected to increase to 67 million by 2030. Arthritis is the nation's most common cause of disability. Simple daily tasks and household chores are challenging to someone who has arthritis in their hands or fingers. Assistive devices can help.

Opening bottles and cans with bare hands has the potential to seriously damage palms, fingernails and joints. Therefore, what is needed is an improved opening device that is useful for opening beverage containers, one that reduces the force needed, fits the hand and can be used in a comfortable position.

BRIEF DESCRIPTION OF THE DRAWINGS

FIG. 13 is a top plan view of the illustrative embodiment of FIG. 11.

FIG. 14 is a side view of the illustrative embodiment of the device of FIG. 13.

FIG. 15 is an end view of the illustrative embodiment of the device of FIG. 13.

FIG. 16 is an end view of the illustrative embodiment of the device of FIG. 13.

FIG. 17 is a sectional view of the illustrative embodiment of the device of FIG. 13 taken along line 17-17.

DETAILED DESCRIPTION

Figure 1:
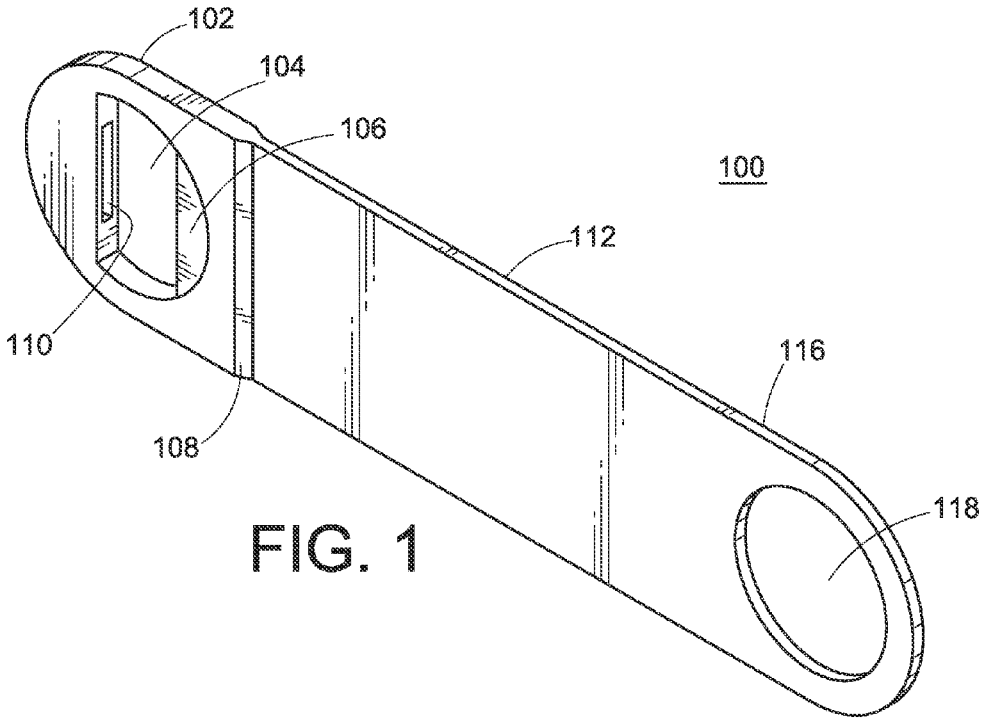
FIG. 1 is a perspective view of an illustrative embodiment of the opening device.

Provided is a tool that is useful for opening sealed containers, such as beverage and food containers of various types. The opening device may be used to open any container having an opening sealed with a bottle cap or a stay-on tab. By way of illustration, this could be utilized to open food and beverage containers, pet food containers, and the like. The opening device easily removes bottle caps, twist-off style bottle caps and opens stay-on-tab cans. The opening device increases the speed with which containers may be opened and helps to protect the hands by reducing the force needed to open containers.

According to certain illustrative embodiments, the opening device comprises a substantially planar, elongated bar with a first end, a second end, and a connecting portion extending between the first and second ends; the first end includes a first opening and a second opening; the first opening having an inner projection to engage and remove a bottle cap; the second opening comprising a recessed, horizontal slot defined in the outer edge of the first end which is adapted to partially receiving the free end of a beverage can stay-on tab. According to certain embodiments, the opening device may comprise a third opening located at the second end, opposite the first opening.

According to other illustrative embodiments, the opening device comprises a substantially planar, elongated bar with a bifurcated first end, a second end, and a connecting portion extending between the ends. The bifurcated first end may have a first opening and a second opening. The first and second openings have inner projections to engage and simultaneously remove a plurality of container lids. According to certain embodiments, the opening device may include a third opening located at the second end comprising a recessed, horizontal slot defined in the outer edge of the second end, adapted to partially receiving the free end of a beverage can stay-on tab.

According to further illustrative embodiments, the opening device comprises a substantially planar, elongated bar with a first end, a second end, and a connecting portion extending between the first and second ends. The first end includes a first opening, the first opening having an inner projection operable to engage and remove a container lid. The second end includes a second opening, the second opening may comprise a recessed, horizontal slot defined in the outer edge of said second end, sized to partially receive the free end of a beverage can stay-on tab. Without limitation, the opening device may include a plurality of slots to secure a flexible material for installation in the slots.

The opening device is grasped in the hand at or near the connecting portion and is used in the manner of a lever to pry a bottle cap loose thereby opening the container. The opening device is operative utilizing either an upward or downward motion. A bottle cap may be expediently removed either by engaging the bottle cap edge closest to the user and pushing up or by engaging the edge furthest from the user and operating the device with a downward motion.

In certain embodiments, a horizontal, recessed slot defined in the outer edge of the opening device is useful for opening a stay-on tab beverage container. The pull ring, of the stay-on tab opening mechanism, is positioned flat to the top of the beverage container making it difficult to grasp and lift. The slotted end of the opening device is adapted to receiving the pull ring and is easily slid over the free end of the stay-on tab closure. Once in place, a slight upward movement of the opening device opens the container.

According to other embodiments, the opening device including a horizontal, recessed slot defined in the outer edge of the opening device for opening a stay-on tab beverage container does not include an opening for removing a bottle cap. This embodiment of the opener is intended to open only can tabs.

The opening device may help to reduce the force or grip strength needed to operate the device. In certain embodiments, the opening device allows the user to generate more leverage by applying a smaller force at a greater distance. In yet further embodiments, the opening device comprises a wider handle which allows the grip force, and resultant contact stress, to be distributed over a larger surface and thus decreases the grip strength necessary to operate the device.

In certain embodiments, the opening device may be utilized to remove two bottle caps simultaneously. The user secures two bottles with one hand and grasping the opening device with the other hand, engages and simultaneously removes both bottle caps. This feature reduces the time and effort required to open multiple bottles, saving wear and tear on the hands and may help to reduce injuries due to repetitive motion. Opening multiple containers with a single motion serves to increase efficiency and productivity which is especially useful for bartenders who may open and serve hundreds of beverages during a busy work shift. The ability to serve customers more quickly may increase sales and customer satisfaction.

In a further embodiment, the opening device may further comprise an opening useful for storing the device. The opening may be utilized to hang the device on a hook, or to attach the device to a retractable reel, so that the device may be conveniently stored and kept within easy reach. The opening may also be utilized to grasp the device so that it can be put into and out of a pants pocket quickly and with little effort. When the device is placed in a back pocket with the opening straight up, it can be easily grasped, used to open a bottle and then placed back into the pocket quickly and efficiently. This is an especially helpful feature for users who switch tasks rapidly, such as bartenders, and saves time by keeping the tool immediately accessible.

According to an embodiment, the opening device is sized to fit comfortably in the palm of the user's hand and may be held tightly to the hand by a band or strap. The opening device may include a plurality of slots generally located in the connecting portion and the second end. The band or strap may be installed within the slots and is useful for securing the opening tool to the user's hand. The band or strap may be comprised of a flexible material including, for example, elastic, fabric, plastic, rubber, leather and the like. The band or strap may include an adjustable closure providing a close fit for hands of various sizes and making it easy to put on and take off. The closure may comprise, for example and without limitation, a hook-and-loop fastener such as Velcro®.

In certain embodiments, the opening device may be manufactured from metals, metal alloys, fiberglass, plastics, composite materials, wood and combinations thereof. According to certain embodiments, the opening device may be manufactured from a rigid plastic material. The use of a plastic or fiberglass material is of a benefit being lightweight and less expensive to manufacture and ship.

According to certain embodiments, the opening device may include a coating or covering for facilitating gripping. The opening device may be entirely coated or covered, or a portion thereof, to improve gripping ability. The opening device may be coated with, including but not limited to, vinyl, PVC, powder coating, rubber, rubberized plastic and the like.

The opening device may include a covering, for example, a gel-grip cushion or soft gel-grip insert that cushions the hand, providing comfort, and improving gripping ability. The cushion or gripping material may provide slip resistance and reduce grip force.

In other embodiments, the opening device may include indicia, for example and without limitation, such as advertising logos, promotional logos, slogans, company names, service provider names, sports team logos, sports team names, expressions, photos, pictures, graphics, drawings, personalization and combinations thereof. The indicia may appear, for example, on the connecting portion, or on the band of various embodiments of the opening device.

The opening device will now be further described in connection with certain illustrative embodiments depicted in the drawing Figures. It should be noted that the opening device should not be limited to the illustrative embodiments depicted by the Figures.

Figure 2:
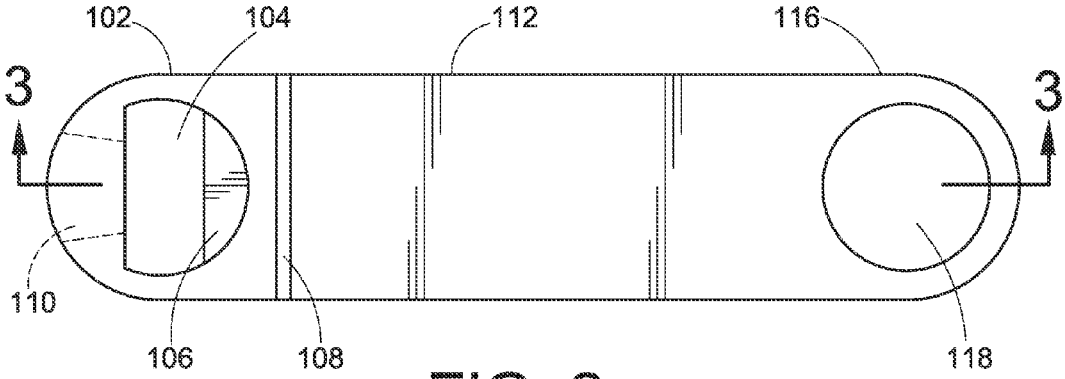
FIG. 2 is a top plan view of an illustrative embodiment of the opening device.
Figure 3:
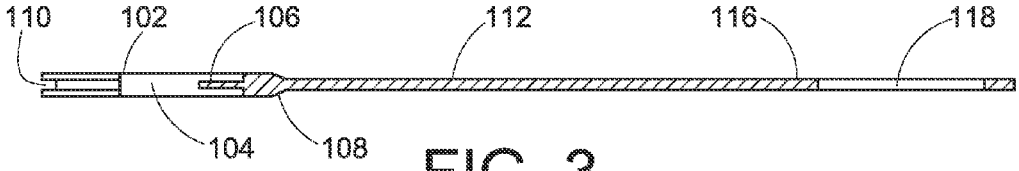
FIG. 3 is a sectional view of one illustrative embodiment of the opening device.
Figure 4:
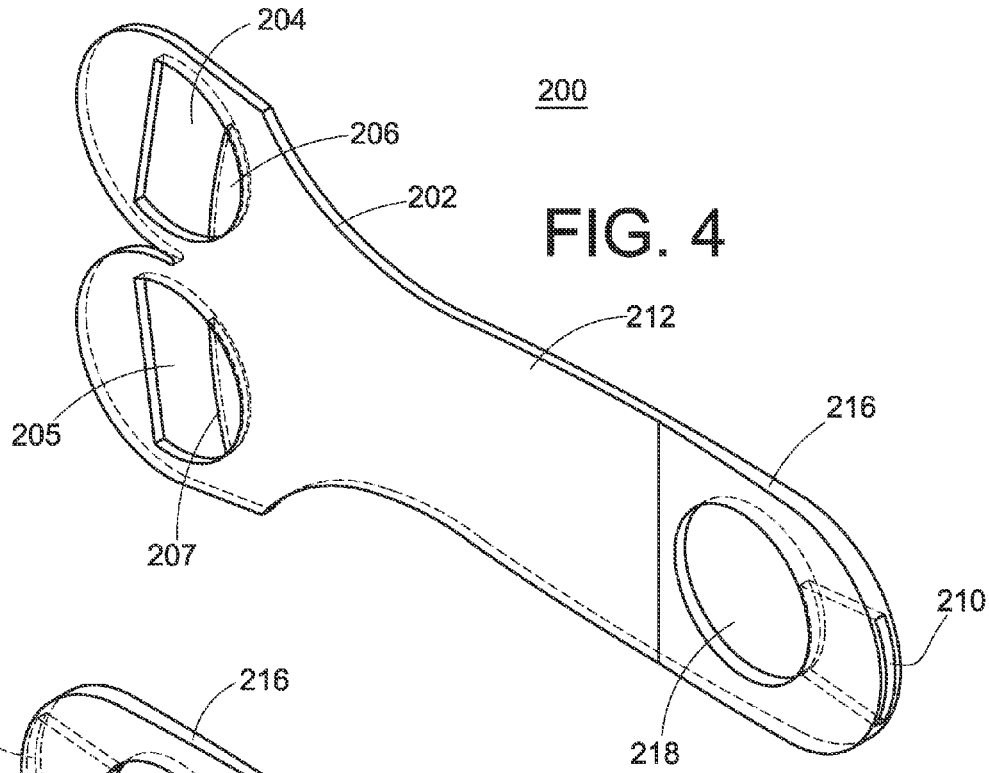
FIG. 4 is a perspective view of another illustrative embodiment of the opening device.
Figure 5:
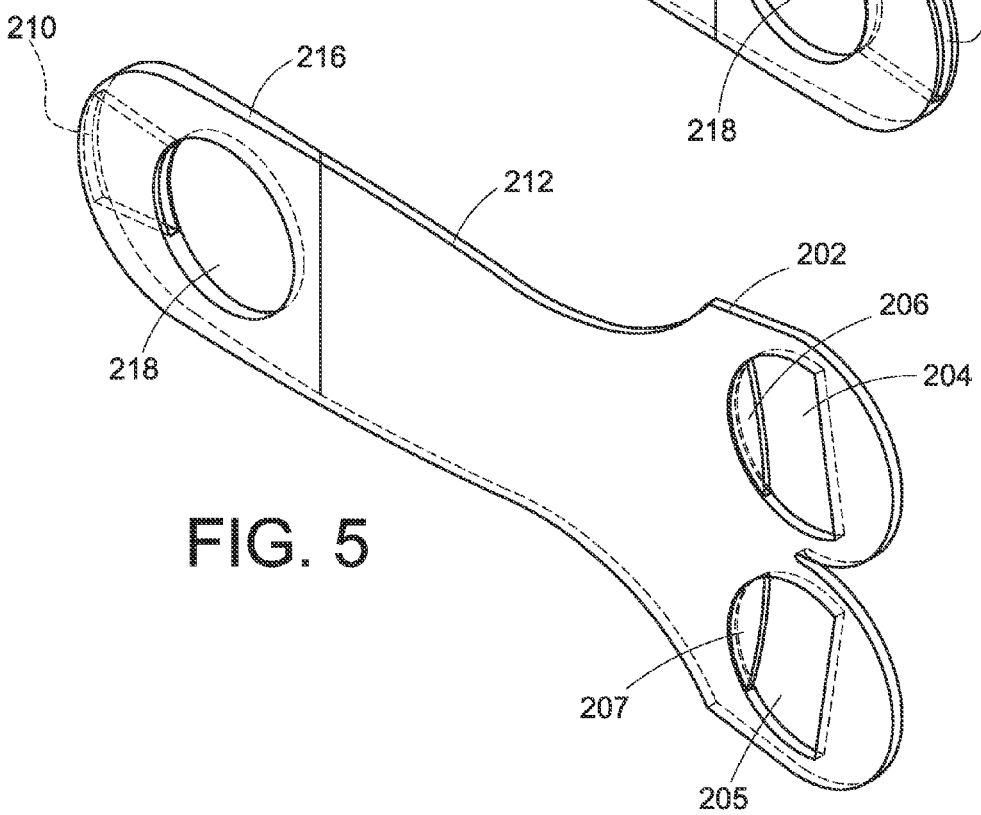
FIG. 5 is a back perspective view of the illustrative embodiment of FIG. 4.
Figures 6, 7, 8, 9, 10:
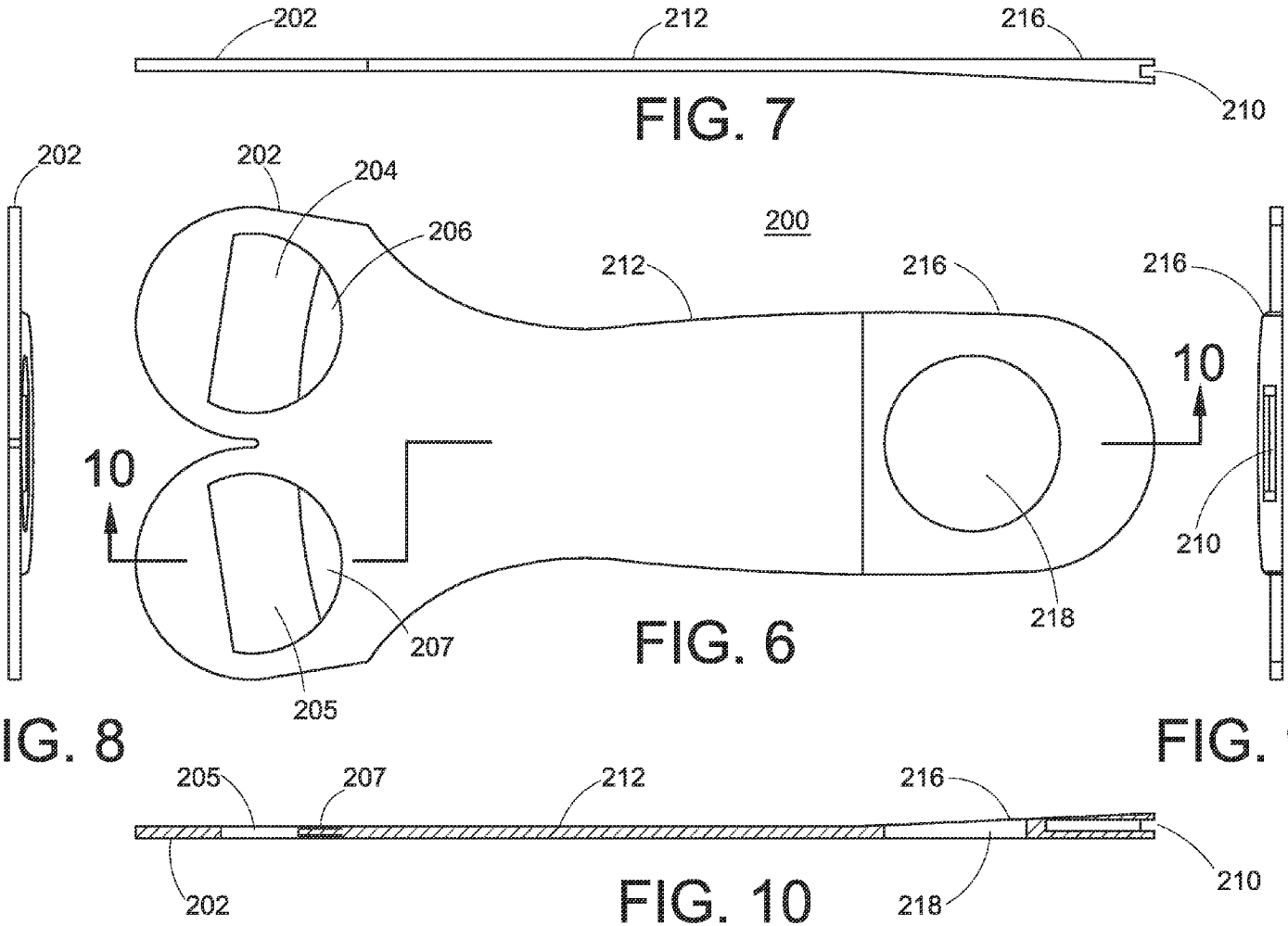
FIG. 6 is a top plan view of the illustrative embodiment of FIG. 4.
FIG. 7 is a side view of the illustrative embodiment of the device of FIG. 6.
FIG. 8 is an end view of the illustrative embodiment of the device of FIG. 6.
FIG. 9 is an end view of the illustrative embodiment of the device of FIG. 6.
FIG. 10 is a sectional view of the illustrative embodiment of the device in FIG. 6 taken along line 10-10.
Figure 11:
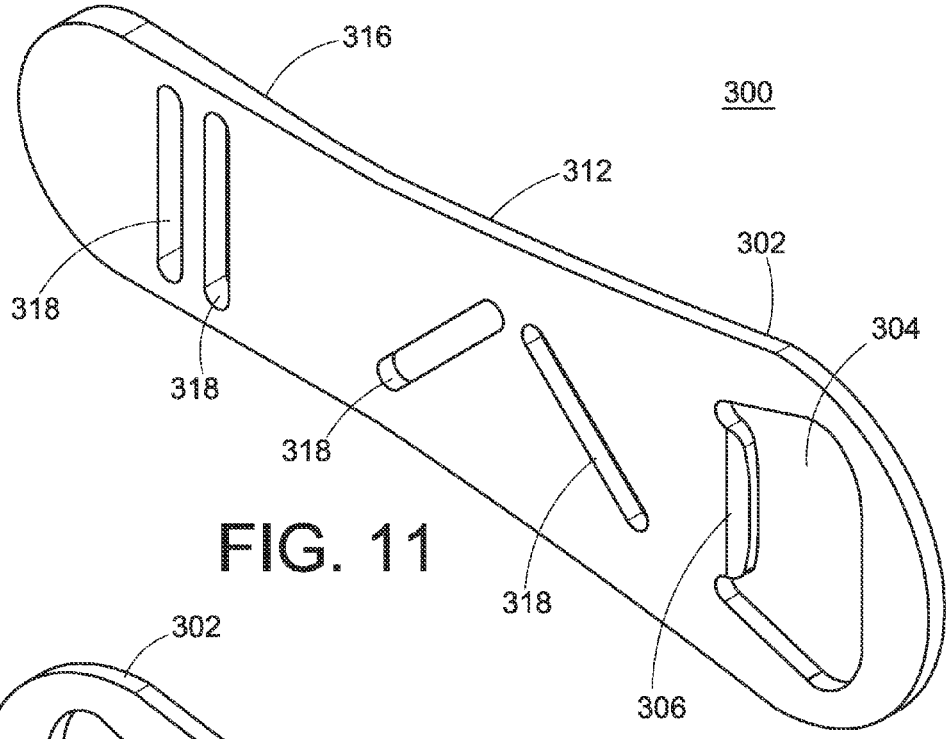
FIG. 11 is a front perspective view of an illustrative embodiment of the opening device.
Figure 12:
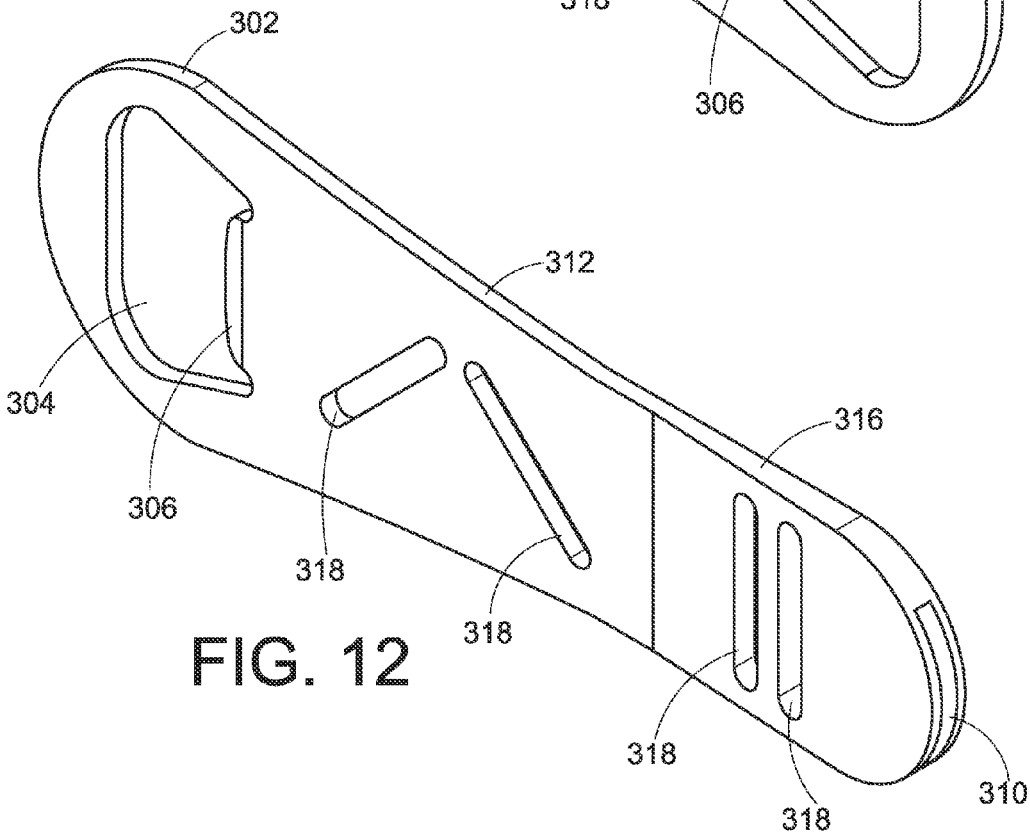
FIG. 12 is a rear perspective view of the illustrative embodiment of FIG. 11.

As shown in FIGS. 1-3, the opening device 100 comprises a substantially planar, elongated bar with a first end 102, a second end 116, and a connecting portion 112. The first end 102 may include a first opening 104 and a second opening 110. The first opening 104 having an inner projection 106 operable to engage and remove a bottle cap. The second opening 110 may comprise a recessed, horizontal slot defined in the outer edge of said first end 102, adapted to partially receiving the free end of a beverage can stay-on tab.

In certain embodiments, the inner projection 106 comprises a tab or flange extending across at least a part of the opening. As shown, the inner projection 106 terminates in a straight edge, however, the tab or flange may comprise any shape so long as the tab can engage a bottle cap and remove it from a bottle.

The first end 102 of opening device 100 may have an increased thickness as compared to the connecting portion 112 and the second end 116. The additional thickness accommodates the inner projection 106 and the second opening 110 of the first end 102. A shoulder 108 forms the transition between the first end 102 and the connecting portion 112.

According to certain embodiments, the opening device may further comprise a third opening 118 generally located at the second end 116, opposite said first opening 104. The third opening 118 may be used to hang the device on a hook, or to attach the device to a retractable reel, so that the opening device may be conveniently stored and kept within easy reach.

In a further embodiment, not shown in the drawing FIG. 1, the first end 102 of opening device 100 may only include a second opening 110 and does not include the first opening 104 or inner projection 106. The second opening 110 may comprise a recessed, horizontal slot defined in the outer edge of said first end 102, adapted to partially receiving the free end of a beverage can stay-on tab. This embodiment of the opener is intended to open only beverage can tabs.

Turning to FIGS. 4-10, in certain embodiments, the opening device 200 comprises a substantially planar, elongated bar with a first end 202, a second end 216, and a connecting portion 212 extending between the ends; said first end 202 with a first opening 204 and a second opening 205. The first and second openings 204, 205 include inner projections 206, 207 operable to engage and simultaneously remove a plurality of container lids. The opening device 200 may also include a third opening 210 located at the second end 216 comprising a recessed, horizontal slot defined in the outer edge of said second end, adapted to partially receiving the free end of a beverage can stay-on tab.

Similar to inner projection 106 of opening device 100, the inner projections 206, 207 of opening device 200 may comprise tabs or flanges of any shape so long as they can engage the bottle caps and remove them from the bottles.

According to certain embodiments, the opening device 200 may include a fourth opening 218 being generally located at the second end 216 opposite the first openings 204, 205 of the first end 202. The fourth opening 218, similar to the third opening 118 of the opening device 100, may be used to facilitate the storage and accessibility of the opening device 200.

As shown in FIGS. 11-17, the opening device 300 comprises a substantially planar, elongated bar with a first end 302, a second end 316, and a connecting portion 312 extending between the ends. The first end 302 includes a first opening 304, the first opening 304 having an inner projection 306 operable to engage and remove a container lid. The second end 316 includes a second opening 310, the second opening 310 may comprise a recessed, horizontal slot defined in the outer edge of said second end 316, sized to partially receive the free end of a beverage can stay-on tab.

Similar to the inner projection 106 of opening device 100, inner projection 306 of opening device 300 may comprise a tab or flange of any shape so long as it can engage a bottle cap and remove it from a bottle.

Figure 18:
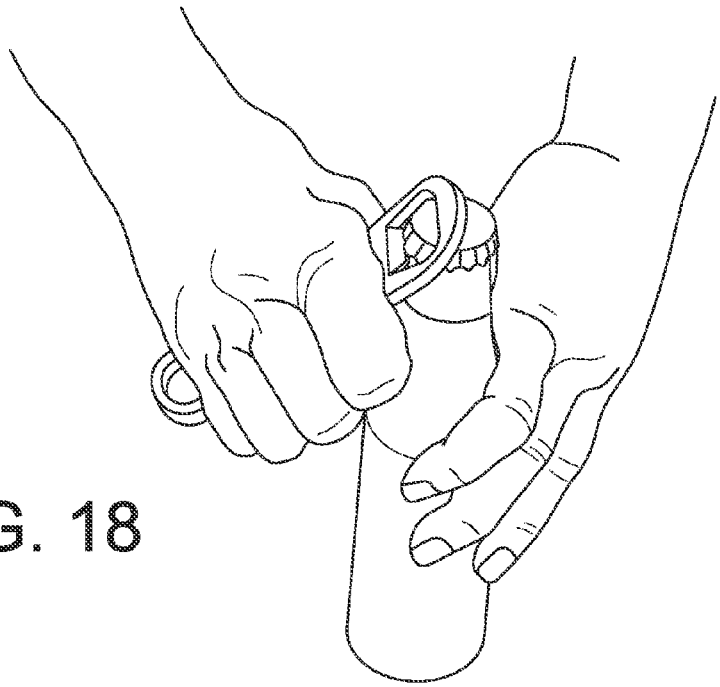
FIG. 18 shows the illustrative embodiment of FIGS. 11-17 opening a bottled beverage container.

The opening device 300 is shown in FIG. 18 being used to remove a crown-style bottle cap from a beverage container. The opening device 300 fits comfortably in the hand and is grasped at or near the connecting portion 312 and the second end 316. The inner projection 306 is used to engage and remove a crown-style bottle cap. In certain embodiments, the opening device 300 may be used to open both bottled beverage containers and stay-on tab can containers.

Figure 19:
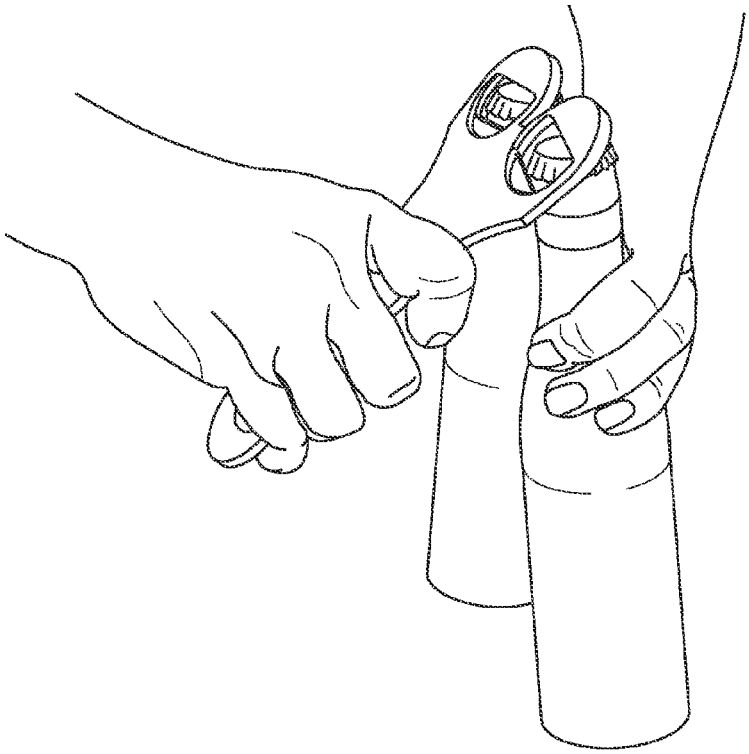
FIG. 19 shows the illustrative embodiment of FIGS. 4-10 opening multiple bottled beverage containers.

FIG. 19 is an illustration of the opening device 200 shown opening multiple bottled beverage containers simultaneously. Two bottled beverage containers are positioned in one hand and the opening device 200 is held in the other hand so as to engage and remove both bottle caps at once.

Figure 20:
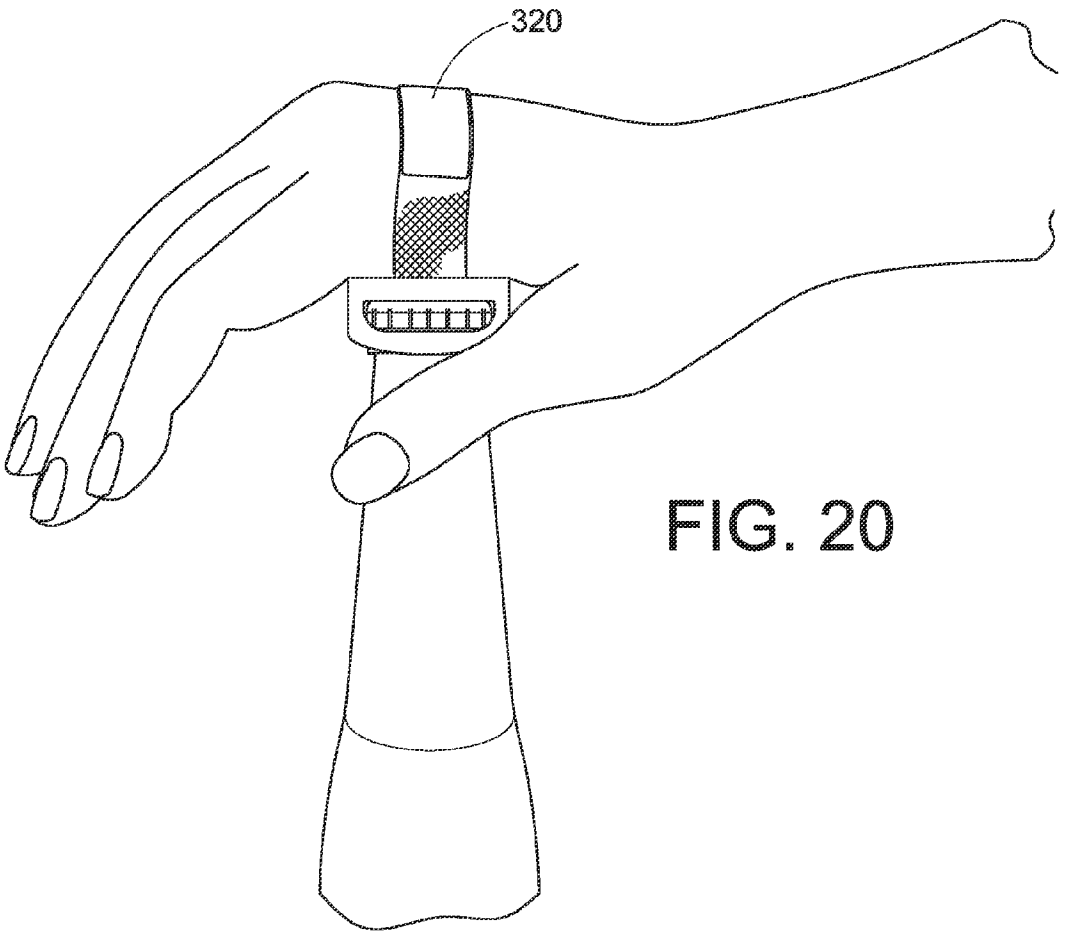
FIG. 20 shows the illustrative embodiment of FIG. 22 opening a bottle.

FIG. 20 is an illustration of the opening device 300, shown with a flexible band 320 installed. The flexible band 320 may be comprised of a stretchy, elastic material and is useful for securing the opening device firmly to the hand. With the opening device 300 secured to the hand in the manner shown, a person may undertake a variety of tasks and return to opening beverage containers without having to pick up and put down the opening device 300.

Figure 21:
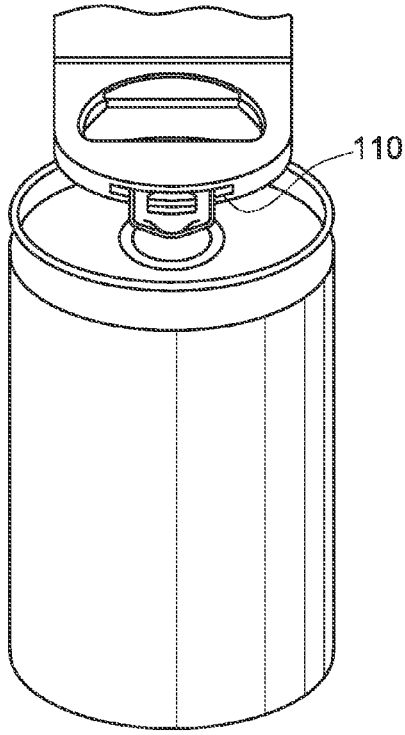
FIG. 21 shows the illustrative embodiment of the device of FIGS. 1-3 opening a beverage can.

FIG. 21 is an illustration of opening device 100 shown opening a stay-on tab beverage container. The recessed horizontal slot 110 in the outer edge of the opening devices 100 is adapted to receive the free end of the stay-on tab closure of a beverage can as shown. The slot is easily slid over the pull ring section of the tab and the can is opened with a slight upward motion of the opening device.

Figure 22:
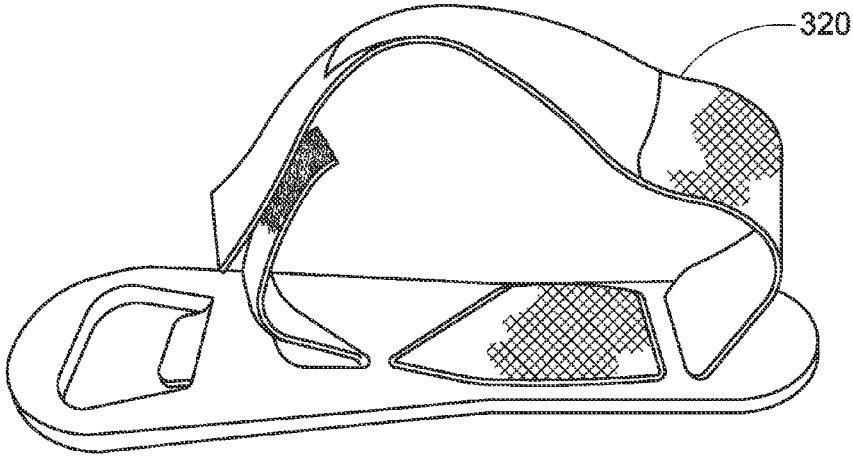
FIG. 22 shows the illustrative embodiment of FIGS. 11-17 with a band engaged therewith.

The opening device 300, as shown in FIG. 22, may include a flexible band 320. The flexible band 320 is threaded through the slots 318, which extend through the thickness of the opening device 300. The flexible band 320 includes an adjustable closure which provides a custom fit to the hand and makes it easy to put on and take off.

While the opening device has been described in connection with various illustrative embodiments, it is to be understood that other similar embodiments may be used or modifications and additions may be made to the described embodiments for performing the same function disclosed herein without deviating therefrom. The embodiments described above are not necessarily in the alternative, as various embodiments may be combined to provide the desired characteristics. Therefore, the opening device should not be limited to any single embodiment, but rather construed in breadth and scope in accordance with the recitation of the appended claims.

The invention claimed is:

1. An opening device comprising:

a substantially planar, elongated bar with a first end and a second end, and a connecting portion extending between the ends;

said first end including a first opening;

a second opening located at said first end comprising a horizontal slot formed within in the thickness of the bar and defined by four walls.

2. The opening device of claim 1, further comprising:

said first opening having an inner projection to engage and remove a bottle cap.

3. The opening device of claim 2, further comprising:

a third opening being generally located at said second end of said bar.

4. The opening device of claim 3, further comprising:

indicia selected from the group consisting of advertising logos, promotional logos, slogans, company names, service provider names, sports team logos, sports team names, photographs, pictures, drawings, graphics personalization and combinations thereof, applied to said elongated bar.

5. The opening device of claim 3, further comprising:

a coating or covering for facilitating gripping of said opening device.

6. An opening device comprising:

a substantially planar, elongated bar with a bifurcated first end and a second end, and a connecting portion extending between the ends;

said first end including a first opening and a second opening;

said first and second openings having inner projections to engage a bottle cap.

7. The opening device of claim 6, further comprising:

a third opening located at said second end comprising a recessed, horizontal slot defined in the outer edge of said first end.

8. The opening device of claim 7, further comprising:

a fourth opening generally located at said second end opposite said first opening of said first end.

9. The opening device of claim 8, further comprising:

indicia selected from the group consisting of advertising logos, promotional logos, slogans, company names, service provider names, sports team logos, sports team names, photographs, pictures, drawings, graphics personalization and combinations thereof, applied to said elongated bar.

10. The opening device of claim 8, further comprising:

a coating or covering for facilitating gripping of said opening device.

11. An opening device comprising:

a substantially planar, elongated bar with a first end and a second end, and a connecting portion extending between the ends;

said first end including a first opening;

said first opening having an inner projection projecting into said first opening to engage a bottle cap;

said second end including a second opening;

a second opening located at said first end comprising a horizontal slot formed within in the thickness of the bar and defined by four walls.

12. The opening device of claim 11, further comprising:

a plurality of slots extending through the thickness of the opening device.

13. The opening device of claim 12, wherein:

said plurality of slots are located in said connecting portion and said second end.

14. The opening device of claim 13, further comprising:

a flexible band threaded through said slots.

15. The opening device of claim 14, further comprising:

indicia selected from the group consisting of advertising logos, promotional logos, slogans, company names, service provider names, sports team logos, sports team names, photographs, pictures, drawings, graphics personalization and combinations thereof, applied to said flexible band.

16. The opening device of claim 11, further comprising:

indicia selected from the group consisting of advertising logos, promotional logos, slogans, company names, service provider names, sports team logos, sports team names, photographs, pictures, drawings, graphics personalization and combinations thereof, applied to said elongated bar.

* * * * *